US006061885A

United States Patent [19]

White et al.

[11] Patent Number: 6,061,885

[45] Date of Patent: May 16, 2000

[54] PRESS ROLL SYSTEM

[75] Inventors: James S. White, Shaftsbury, Vt.; David M. Ascevich, Williamstown, Mass.; Edward C. Kirchner; Sadao Yagi, both of Pittsfield, Mass.

[73] Assignee: Morrison Berkshire, Inc., North Adams, Mass.

[21] Appl. No.: 09/322,511

[22] Filed: May 28, 1999

[51] Int. Cl.[7] ..... D06C 3/00; D06C 21/00

[52] U.S. Cl. ..... 26/18.6; 26/71; 28/142

[58] Field of Search ..... 26/18.6, 18.5, 26/51, 71, 99, 80, 1; 28/142, 165, 167; 162/272, 273, 274

[56] References Cited

U.S. PATENT DOCUMENTS

| | | | |
|---|---|---|---|
| 2,144,151 | 1/1939 | Heinen . | |
| 2,327,712 | 8/1943 | Huey et al. . | |
| 2,440,209 | 4/1948 | Redman . | |
| 2,765,514 | 10/1956 | Walton . | |
| 2,808,635 | 10/1957 | Parker et al. . | |
| 3,007,223 | 11/1961 | Wehrmann | 26/18.6 |
| 3,011,545 | 12/1961 | Welsh et al. | 26/18.6 |
| 3,035,512 | 5/1962 | Beachler . | |
| 3,090,666 | 5/1963 | Jones . | |
| 3,110,612 | 11/1963 | Gottwald et al. | 26/18.6 |
| 3,188,372 | 6/1965 | Roos . | |
| 3,220,056 | 11/1965 | Walton . | |
| 3,331,113 | 7/1967 | Tugen et al. . | |
| 3,390,218 | 6/1968 | Painter et al. . | |
| 3,447,453 | 6/1969 | Rojecki . | |
| 3,522,719 | 8/1970 | Bruckner . | |
| 3,695,064 | 10/1972 | Runton . | |
| 3,832,758 | 9/1974 | Johnson . | |
| 3,866,277 | 2/1975 | Hojyo | 26/18.6 |
| 4,003,783 | 1/1977 | Groome et al. | 26/18.6 |
| 4,162,563 | 7/1979 | Lawrence et al. . | |
| 4,256,537 | 3/1981 | Stanislaw | 28/142 |
| 4,400,238 | 8/1983 | Stanislaw et al. | 28/142 |
| 5,704,102 | 1/1998 | Catallo | 26/18.6 |
| 5,901,422 | 5/1999 | White et al. . | |
| 5,901,423 | 5/1999 | White et al. . | |

*Primary Examiner*—Amy B. Vanatta

*Attorney, Agent, or Firm*—Lerner, David, Litternberg, Krumholz & Mentlik, LLP

[57] ABSTRACT

A press roll system employed in connection with a web finishing assembly is provided. The press roll system includes a press roll, which cooperates with a head roll to provide a uniform nip area and pressing load; a support substrate, arranged between the ground and the press roll; at least one backup roller mounted to a first surface of the support substrate along a continuous axis for substantially the length of the press roll, and arranged to provide a uniform load to the press roll and uniform area between the press roll and head roll during operation to impart a uniform caliper to the web; and a retractable force actuator, mounted on a second surface of the support substrate, opposite the surface to which the backup rollers are mounted, to provide an even distribution of loads toward the press roll. A channel is attached to one end of the support substrate for receiving and channeling working fluid away from the rest of the press roll system.

27 Claims, 9 Drawing Sheets

PRESS ROLL SYSTEM

FIELD OF THE INVENTION

The present invention generally relates to endless web finishing assemblies. More particularly, the present invention relates to a novel press roll system for use with such finishing assemblies.

BACKGROUND OF THE INVENTION

Quality paper is commonly produced on multi-stage paper making assemblies. Generally, a paper making assembly includes a forming stage, a press stage, a dryer stage, and a winding and cutting stage. Several of these stages incorporate an endless loop or web (e.g., fabric or felt endless web) on which the paper may be formed or treated.

The paper making process begins by placing a slurry mixture on a first web, employed by the forming stage machine. Next, in the press stage, as water is removed, the paper mixture begins to take shape on a second web. During these early stages, the paper's surface characteristics are dictated by the web surfaces on which the paper is being formed. That is, the finished paper will include imperfections as a result of the webs embedding their imperfections into the paper. Thus, to avoid these imperfections, the webs must be manufactured to precise specifications, maintaining a surface that is smooth and devoid of any imperfections or variations. Ideally, the webs are made of endless loops, i.e., without seams, which helps to minimize the imperfections.

Typically, endless webs are first manufactured on web making machines, such as large needling looms. One such needling loom is available from the assignee of the present invention, namely, Morrison Berkshires, Inc., of North Adams, Mass. Then, the webs are transferred to a finishing assembly for setting. There, the webs are typically treated with chemicals, mechanical and thermal energy, and the like. The webs also may be stretched while otherwise being treated to achieve a further smooth set surface. The setting process performed on a finishing assembly also must be performed with care and to strict specifications in order to avoid imparting unacceptable imperfections to the webs.

Certain web finishing assemblies include: at least one inside treatment roll, which may heat the endless web on contact (i.e., head roll); at least one inside treatment roll, which may stretch the endless web; and possibly a non-contacting treatment device, such as an air box set (or oven), for heat-setting the endless web. Certain finishing assemblies, used in connection with the present invention, are described in commonly assigned U.S. Pat. Nos. 5,901,422 and 5,901,423, both of which are incorporated by reference herein.

In addition to the stretch roll, the head roll and the air box set, a press roll may be employed. A press roll is typically operated adjacent to one of the inside treatment rolls, for instance, the head roll. Whereas, during operation, the head roll is arranged to contact the inside of the web, the press roll is usually arranged to contact the outside.

The press roll is typically used in combination with the head roll to impart a nip pressure to the fabric web. The press roll also may be used to impart mechanical properties to the web such as certain caliper (i.e. thickness), pre-compaction, and the like. This, in turn, will aid in the removal of working fluid from the web. That is, as the fabric web is being set, certain liquid chemicals may be applied to it. To remove this excess working fluid, the web is nipped between the press roll and the head roll. As a result, the working fluid is pressed out. The working fluid also may drop out on its own due to the web being saturated.

Known press roll assemblies include a press roll adjacent the head roll, spaced apart to allow the fabric web to travel therebetween. In addition, backup rollers may be employed adjacent the press roll, and generally opposite to the head roll. The backup rollers are generally used to support the press roll and prevent it from moving in the machine direction from its predetermined position in relation to the head roll. Additionally, force actuators, typically coupled to pairs of backup rollers, are provided to impart a pressing force to the press roll, through the backup rollers, to create the desired nip pressure between the press roll and the head roll.

In this type of press roll arrangement, it is desirable to apply a consistent nip pressure throughout the entire length of the press and head rolls, at least where the web is located. This will provide for a uniformly set fabric web having a generally uniform caliper. It also is desirable to generate a maximum nip pressure, to remove as much working fluid as possible and impart mechanical and performance properties to the web. This is commonly achieved by using a small diameter press roll.

Small diameter press rolls are preferred because nip pressure is inversely proportional to the diameter of the press roll, at any given force. It should be noted that the larger the force necessary to obtain the required nip pressure, the larger and stronger the head roll so as to keep the overall deflection of the head roll down to a minimum.

Typically, small diameter press rolls will deflect under a normal load and will highly deflect under relatively high loads. It is desirable to keep the amount and degree of deflection of both the press roll and the head roll the same to provide for a uniform pressing load and assure a uniform nip area and thus a generally uniform caliper of the web. Ultimately, it is desirable to have the press roll's deflection characteristics follow those of the head roll.

There are certain problems associated with known press roll systems. One is the non-uniform deflection of the relatively smaller press rolls as compared to the deflection of the head roll. This results, in part, from the press roll not being evenly supported by the force actuators (or actuating devices), via the backup rollers. Instead, discrete pressure points are translated from the force actuators, through the backup rollers, to the press roll. As a result, inconsistencies are imparted to the nip area, hence, causing variations in the web, such as an irregular caliper throughout the web.

Another problem with existing press roll systems is the inconsistency imparted to the web from the arrangement of the backup roller. That is, the backup rollers are normally paired or grouped along the cross machine direction of the web. As a result, gaps exist where no backup rollers are in contact with the press roll. This arrangement imparts an uneven pressure at various points along the press roll, which, in turn, causes variations in the web. That is, in known press roll systems, typically pairs of backup rollers are each coupled to the pair's own force actuator(s). The backup rollers are placed under the press roll in the cross machine direction of the web. Gaps between each pair or group of backup rollers sometimes causes the force upon the press roll to be inconsistent along the cross machine direction of the web. This causes inconsistencies such as fabric markings, variations in the caliper of the web and other such inconsistencies on the web.

Finally, after the working fluid has dropped out or has been pressed out of the web, it typically drains onto the force actuators and other ancillary machinery arranged under the press roll and backup rollers of the finishing assembly This may lead to contamination of those parts.

Thus, there is a need for a press roll system having a relatively small diameter press roll, which is capable of deflecting in step with the deflection of the head roll. There also is a need to have an arrangement of backup rollers that is independent of, or not associated with, any particular force actuator. This arrangement would minimize inconsistent application of forces to the press roll. Finally, there is a need for a press roll system that is capable of channeling the working fluid away from the force actuators and other machinery associated with the press roll system and finishing assembly.

SUMMARY OF THE INVENTION

The present invention addresses these needs and desires.

In accordance with one aspect of the present invention, there is provided a press roll system for use in a web finishing assembly, which includes at least one inside treatment roll extending in a direction generally transverse the machine direction of the finishing assembly. The press roll system includes a press roll having a first end, and a second end remote from the first end, and extending in a direction generally transverse to the machine direction of the finishing assembly and adjacent the inside treatment roll. The press roll is moveable toward the inside treatment roll to provide a nip area for receiving a web and for providing a nip pressure to the web. The press roll system further includes at least one backup roller, which support the press roll. The backup roller extends between the first end of the press roll and the second end of the press roll. A support substrate is provided to support the backup roller. The support substrate may extend between the first end of the press roll and the second end of the press roll. The support substrate also may be non-continuous. That is, the support substrate may include intermittent or discrete portions, mounted along the cross machine direction of the finishing assembly. The press roll system further includes a force actuating assembly for providing a pressing load to the press roll to move the press roll toward the at least one inside treatment roll. The force actuating assembly provides a pressing load to the support substrate, which in turn provides a force to the backup roller. The backup roller impart a pressing force to the press roll, whereby the pressing load is applied to the press roll to uniformly and continuously distribute a nip pressure substantially along the length of the press roll and provide for a substantially uniform caliper of the web.

Preferably, the support substrate includes a first major surface facing toward the press roll, and a second major surface facing away from the press roll. Desirably, the backup roller is mounted to the first major surface of the support substrate and arranged on the first surface of the support substrate to provide for continuous support of the press roll, substantially along the length of the press roll.

Most preferably, the press roll system comprises a plurality of backup rollers, which are arranged on the first surface of the support substrate such that the ends of certain of the plurality of backup rollers are coincident with the ends of adjacent ones of the plurality of backup rollers, thereby providing a continuous support for the press roll.

Preferably, the force actuating assembly includes a single force actuating device and most preferably a plurality of force actuating devices mounted and arranged on the second major surface of the support substrate. Preferably, the plurality of force actuating devices are not associated with the plurality of rollers.

In a most preferred embodiment, the plurality of force actuating devices are retractable toward the second major surface of the support substrate when the press roll system is in a rest state and expandable toward the foundation to provide support and a pressing force to the press roll during operation of the press roll system.

Preferably, the press roll system includes a service cart assembly for supporting and containing the press roll system. The service cart may be employed to move the press roll system away from the finishing assembly, when loading and unloading the web. The service cart also may be used to provide tensioning of the web during the finishing process. Finally, the service cart may be used to support the support plate, backup rollers and force actuating devices, and facilitate the removal of the press roll.

A plurality of load transducers also may be mounted between the second major surface of the support substrate and the plurality of force actuating devices to provide feedback and control of the amount of force to be supplied to the nip area of the press roll system and hence the caliper uniformity. Any number of load transducers may be used and that number does not necessarily correspond to the number of force actuating devices. On the other hand, the number of transducers may be equal to the amount of force actuating devices.

In another aspect of the present invention, there is provided a press roll system, including a support substrate further comprising a channel, positioned at one end of the support substrate for channeling working fluids that may be pressed from the web while the press roll and head roll are applying a nip pressure to the web. The working fluid also may drop off the web because the web is saturated. Preferably, the channel extends along the length of the support substrate but can be either longer or shorter, depending on the arrangement.

Preferably, the support substrate is tilted toward the end where the channel is positioned to facilitate the flow of working fluid toward the channel.

In accordance with yet another embodiment of the present invention, there is provided a press roll system for use in a web finishing assembly, which includes a head roll, extending in a direction generally transverse the machine direction of the finishing assembly. The press roll system includes a service cart, a press roll rotatably secured in the service cart and having a first end and a second end remote from the first end, and extending in a direction generally transverse to the machine direction of the finishing assembly and adjacent the head roll. The press roll is moveable toward the head roll to provide a uniformed nip area to receive a traveling web and to apply a nip pressing force to the web. The press roll system further includes a plurality of backup rollers, which support the press roll and reduce movement of the press roll in the machine direction during operation. The backup rollers extend between the first end of the press roll and the second end of the press roll. A support substrate, preferably for supporting the plurality of backup rollers, also is provided. The support substrate has a first major surface and a second major surface and generally extends between the first end of the press roll and the second end of the press roll. The support substrate also may extend beyond the press roll. The plurality of backup rollers is mounted to the first major surface of the support substrate. Finally, this embodiment includes a plurality of force actuating devices for providing a pressing load to the press roll to move the press roll toward the head roll. The plurality of force actuating devices provide the pressing load to the press roll through the support substrate and the plurality of backup rollers, whereby the load applied to the press roll is uniformly and continuously distributed along substantially the length of the press roll, thus yielding a substantially uniform caliper.

In accordance with another aspect of the present invention, there is provided a press roll system for use in a web finishing assembly, which includes at least one inside treatment roll extending in a direction generally transverse to the machine direction of the finishing assembly. The press roll system includes a press roll having a first end and a second end remote from the first end. The press roll extends in a direction generally transverse to the machine direction of the finishing assembly and adjacent the inside treatment roll. The press roll is moveable toward the inside treatment roll to provide a nip area for receiving a traveling web and for applying a nip pressure force to the web. Also provided is a plurality of backup rollers for supporting the press roll. The plurality of backup rollers may extend between the first end of the press roll and the second end of the press roll. Further, a force actuating assembly is provided for supplying a pressing load to the press roll to move the press roll toward the inside treatment roll. The pressing load is applied to the press roll in a uniform and continuous distribution along substantially the length of the press roll. Finally, a fluid collection substrate is provided, extending lengthwise between the first end of the press roll and the second end of the press roll and arranged beneath the plurality of backup rollers and above the force actuating assembly. This fluid collection substrate also may include a channel for collecting and channeling the working fluid away from the press roll system.

BRIEF DESCRIPTION OF THE DRAWINGS

The above and other features, aspects and advantages of the present invention will become apparent, as will a better understanding of the concepts underlying the present invention, by reference to the description that follows and refers to the accompanying drawings, in which.

DETAILED DESCRIPTION OF THE PREFERRED EMBODIMENTS

The present invention is directed to a press roll system employed by, for example, a finishing assembly for treating an endless web. The web is typically made of, for example, fabric or felt and is typically intended for use in paper making assemblies. Of course, however, the present invention may be applied to other finishing assemblies or other type machines, where a uniformed force is desired such as to create a predetermined and consistent nip pressure and nip area between a press roll and another treatment roll, such as a head roll, heated or not heated. This imparts a generally consistent caliper to the web.

In addition, the present invention may be applied to other applications, where a system is desired that can channel at least some, if not all, of the working fluid of the finishing machine away from other working portions of that machine.

Figure 1:
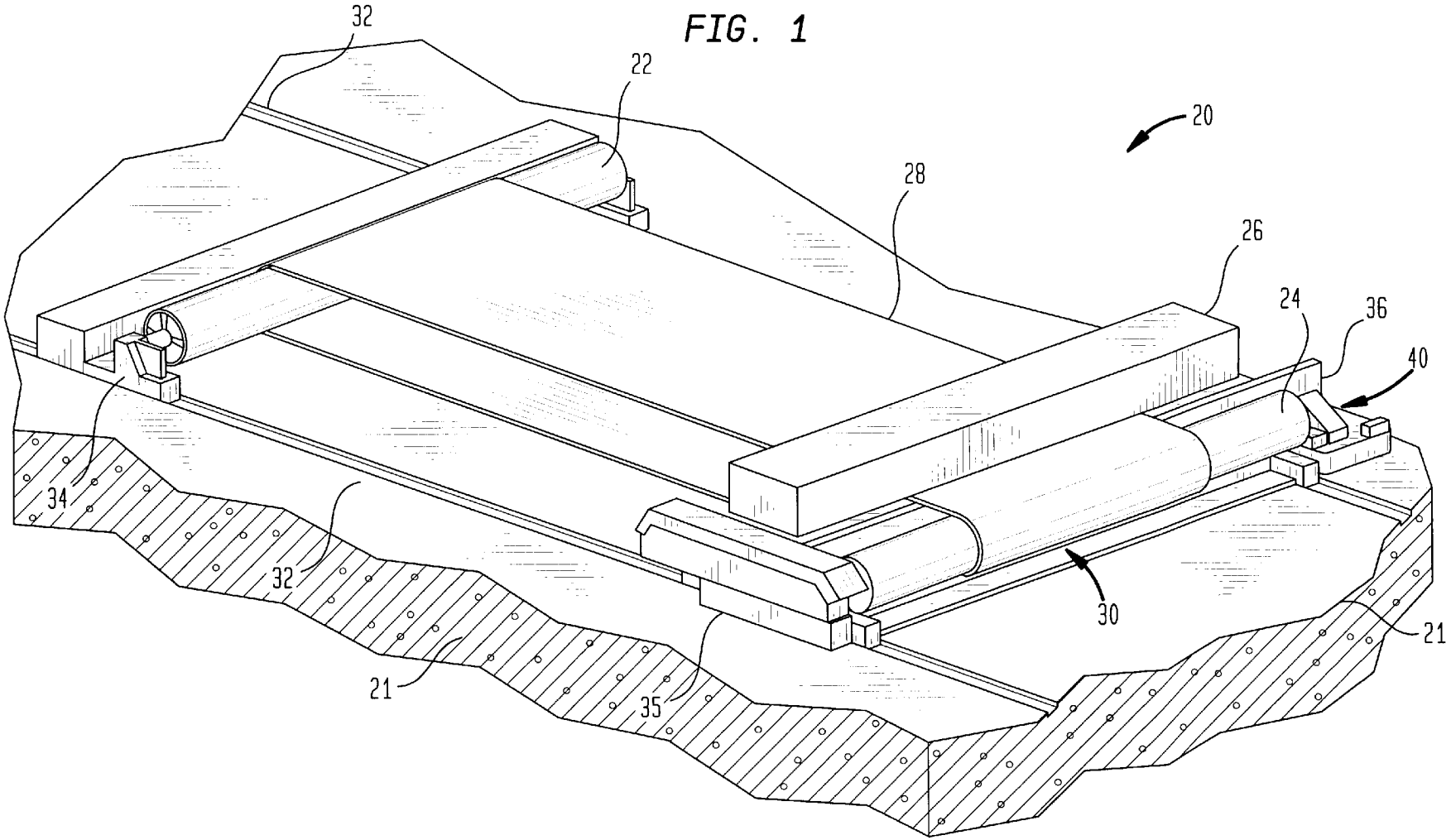
FIG. 1 is a perspective view of a finishing assembly, employing a press roll system in accordance one embodiment of the present invention.

In accordance with one aspect of the present invention, as shown in FIG. 1, there is provided a finishing assembly generally designated 20. The finishing assembly 20 is supported by a foundation or floor 21 and comprises an inside moveable or stretch roll 22, an inside head roll 24, a set of ovens or air boxes 26 and a press roll system 30.

The moveable or stretch roll 22 is supported by a moveable roll carriage 34. The movable roll carriage is provided for moving the inside treatment roll 22 toward and away from the head roll 24. The carriage 34 is guided by tracks 32 set in the foundation 21 along the entire length of the finishing assembly 20 as the carriage 34 moves toward and away from the head roll 24 in the machine direction of the assembly 20.

The air box set 26 and the head roll 24 are supported by cantilevered support beams 36 and 38. The air box set 26 and head roll are further supported by support 35 when the finishing assembly 20 is in operation. Also shown in FIG. 1, as part of the finishing assembly, is a head roll drive mechanism 40, which is of a conventional design and used to drive the head roll in a rotational manner.

Finally, an endless loop or fabric web 28 is shown mounted on the finishing assembly 20. The endless web is shown loaded on the finishing assembly 20 in position for treatment. The air box set 26 is positioned on both the outside and inside of the web 28 for heat treating both sides.

Figure 2:
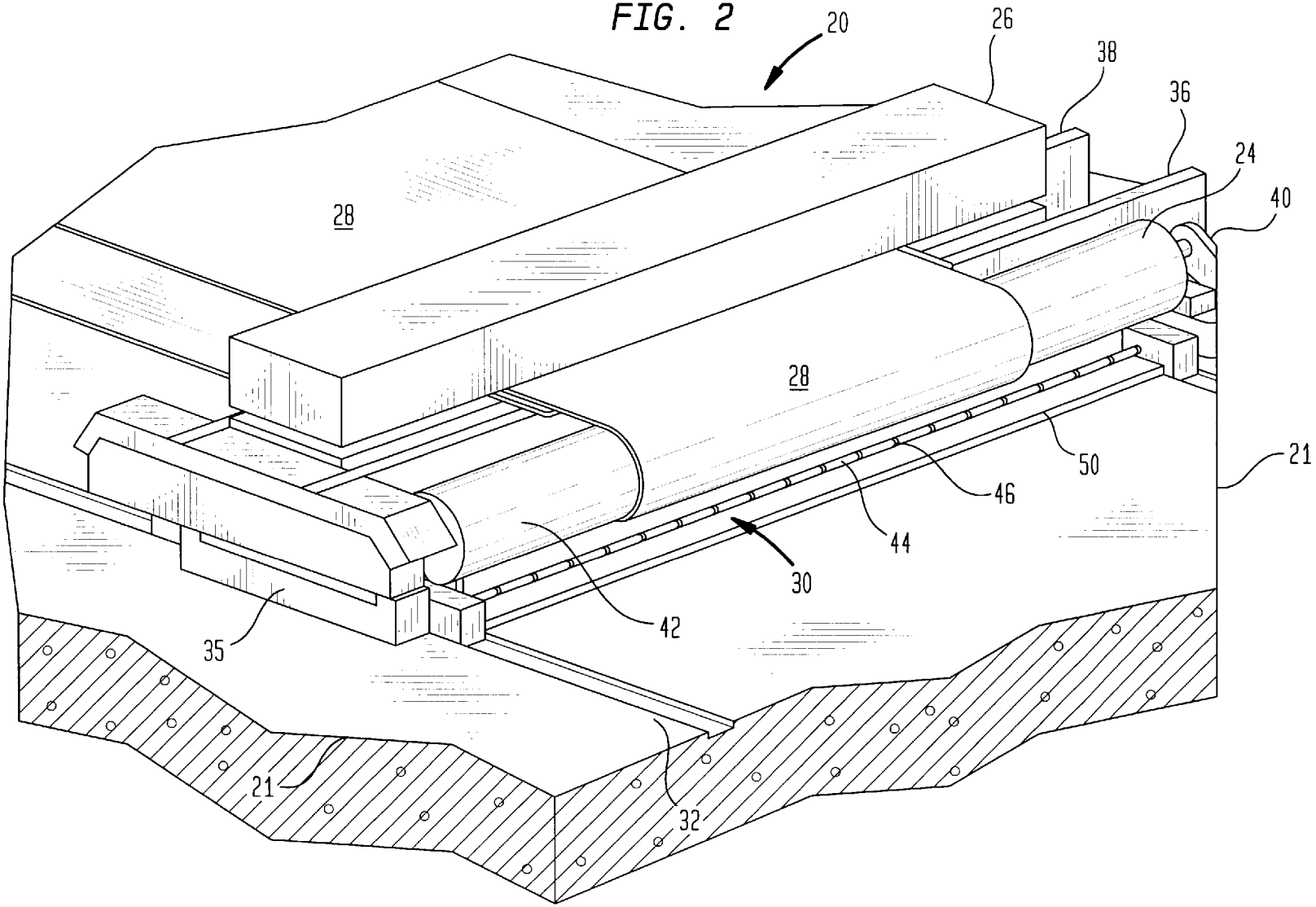
FIG. 2 is a enlarged perspective view of a portion of the finishing assembly of FIG. 1, featuring the press roll system.

As shown in FIG. 2, the finishing assembly is in operational mode. Typically, the web 28 is positioned generally equidistant from the center of the head roll 24, extending in the cross machine direction toward the ends of the head roll. The web, as shown in the Figures, is occupying about one half of the total length of the head roll and press roll. However, the present invention is capable of treating a web that has a width ranging from next to zero to a size that is the full width of the finishing assembly.

FIG. 2 also shows the press roll system 30 in position during operation of finishing or setting the web 28. Specifically, FIG. 2 shows the press roll system 30 adjacent the head roll 24, the press roll 42, backup rollers 44 and mounts 46. Also shown in FIG. 2 is the support substrate 50.

Figure 3:
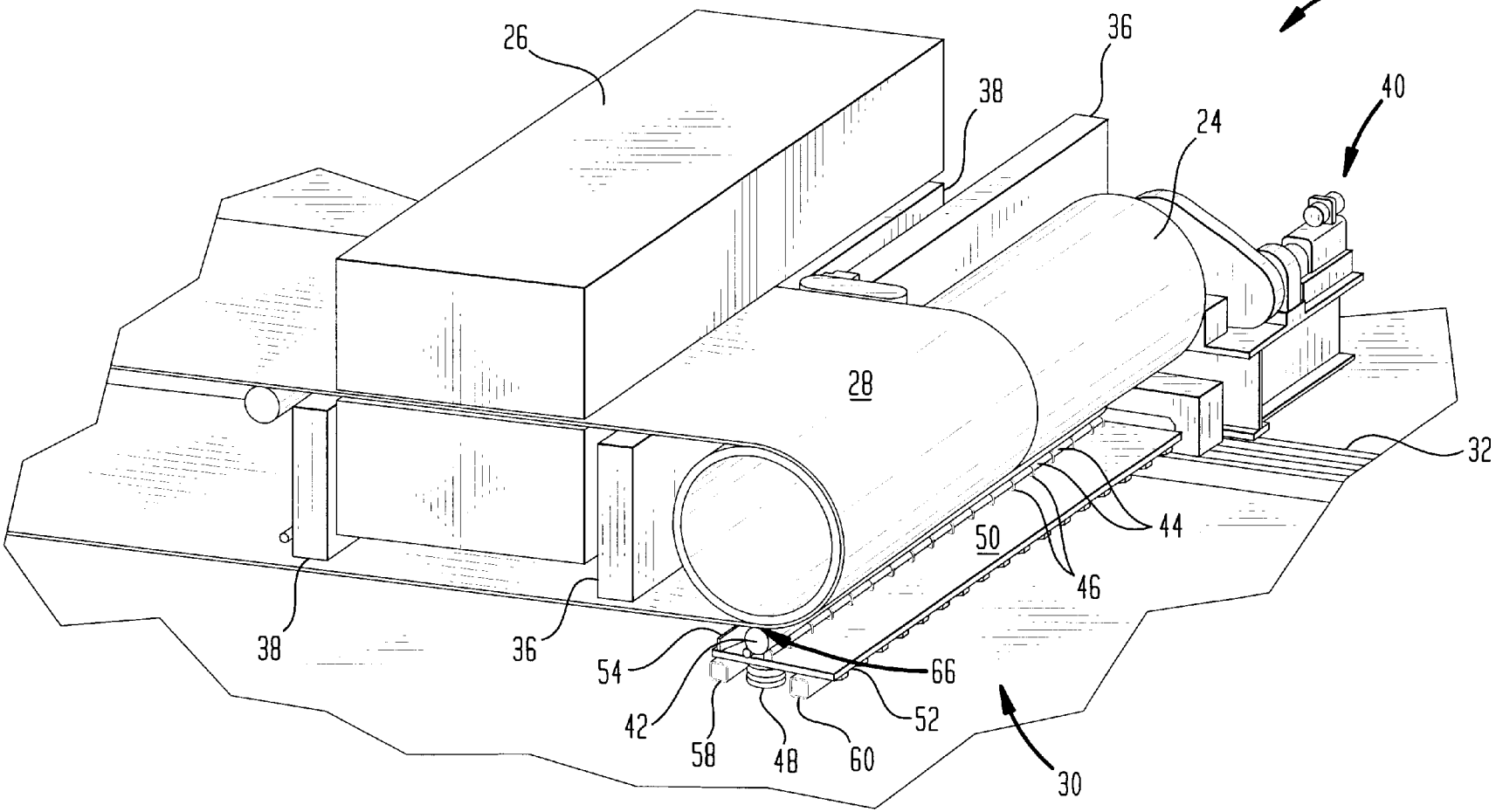
FIG. 3 is a schematic drawing of a portion of the finishing assembly of FIG. 1, cut along its machine direction centerline and featuring the press roll system.

As best shown in FIG. 3, the finishing assembly 20 is depicted cut along its machine direction centerline, featuring the press roll system 30. Again, in this particular embodiment, the support substrate 50 is shown located above the force actuators 48 and below the backup rollers 44 and is provided, in part, to distribute the pressing force being provided by the force actuators 48 uniformly and continuously along the press roll 42, at least continuous along the press roll where the web is present. In this way, the press roll 42 exerts a substantially uniformed force at the nip area 66 between the press roll 42 and the head roll 24. This imparts a substantially consistent pressing load to the web and thus a substantially uniform caliper.

For instance, the press roll 42 is relatively smaller in diameter than the head roll 24. Therefore, as more pressing force is applied from the force actuators 48 to the press roll 42 and subsequently against the head roll 24, in order to create a nipping pressure at the nip area 66, the head roll 24 will begin to deflect or deform. Having the support substrate 50 in place provides for a substantially uniformed deflection of the press roll 42 vis-à-vis the head roll 24 and thus a somewhat uniformed nip area 66. This uniformed nip area provides for a smooth setting or treatment of the web 28, as well as, facilitating the mounting and removal of the web. FIG. 3 also shows support beams 58 and 60, which support the support substrate 50 as well as secure the press roll system to the head roll carriage 35 when in operation.

Figure 4:
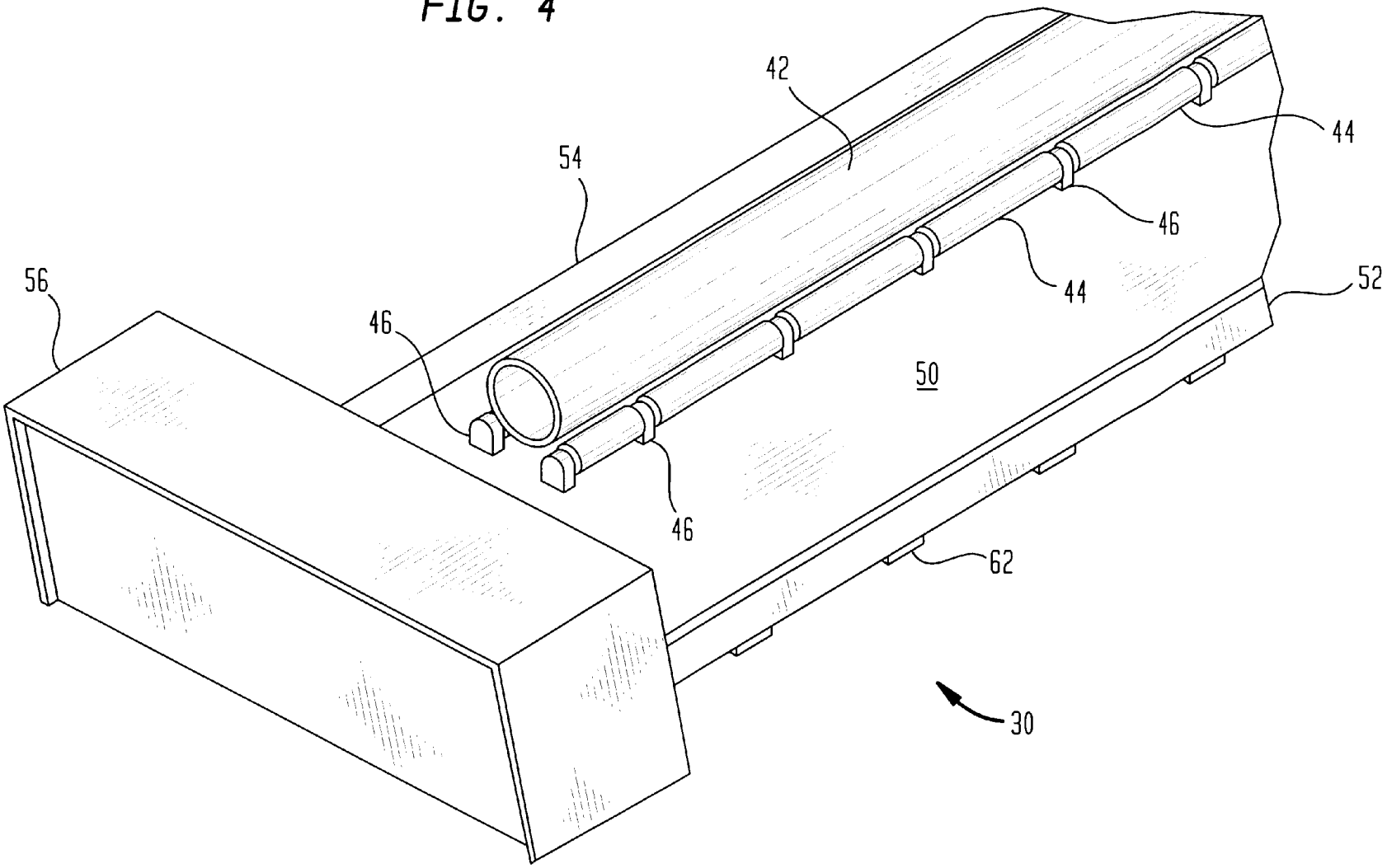
FIG. 4 is a perspective view of the press roll system, illustrating the press roll, backup rollers and the support substrate.

As best seen in FIG. 4, there is provided a support 56, which is positioned in place once the web has been loaded or mounted on to the finishing assembly 20. FIG. 4 also shows the details of the press roll system 30.

The head roll is not shown in FIG. 4 for purposes of clarity of the drawing. Thus, as shown in FIG. 4, there is the press roll 42 supported by two independent rows of backup rollers 44, one row of which is shown in FIG. 4 whereas the second of the two rows are hidden by the press roll 42. The mounts 46 on which the backup rollers are rotatably secured are shown in FIG. 4, as well.

As shown in this particular arrangement, the backup rollers act as a cradle to the press roll 42 in that they prevent the press roll from moving in the machine direction. Therefore, the press roll 42 maintains its position in relation to the remainder of the finishing assembly 20 and the head roll 24. As such, the press roll is generally limited to rotational and axial motion. Also shown in FIG. 4 are ribbed supports 62, which give added support to the support substrate 50. The press roll's diameter is generally smaller in diameter than the head roll.

As shown in FIG. 4, a channel 52 is provided, which is secured to one of the lengthwise edges of the support substrate 50. The channel may be integral as well. This channel 52 is provided, in part, to receive working fluid that may drop out or be pressed out of the felt 28 during a setting operation, in which the felt or web is nipped between the press roll 42 and the head roll 24. Finally, a splash guard 54 is shown secured to the opposite lengthwise edge of the support substrate 50. The channel also may be located at one of the width-wise ends.

Figure 5:
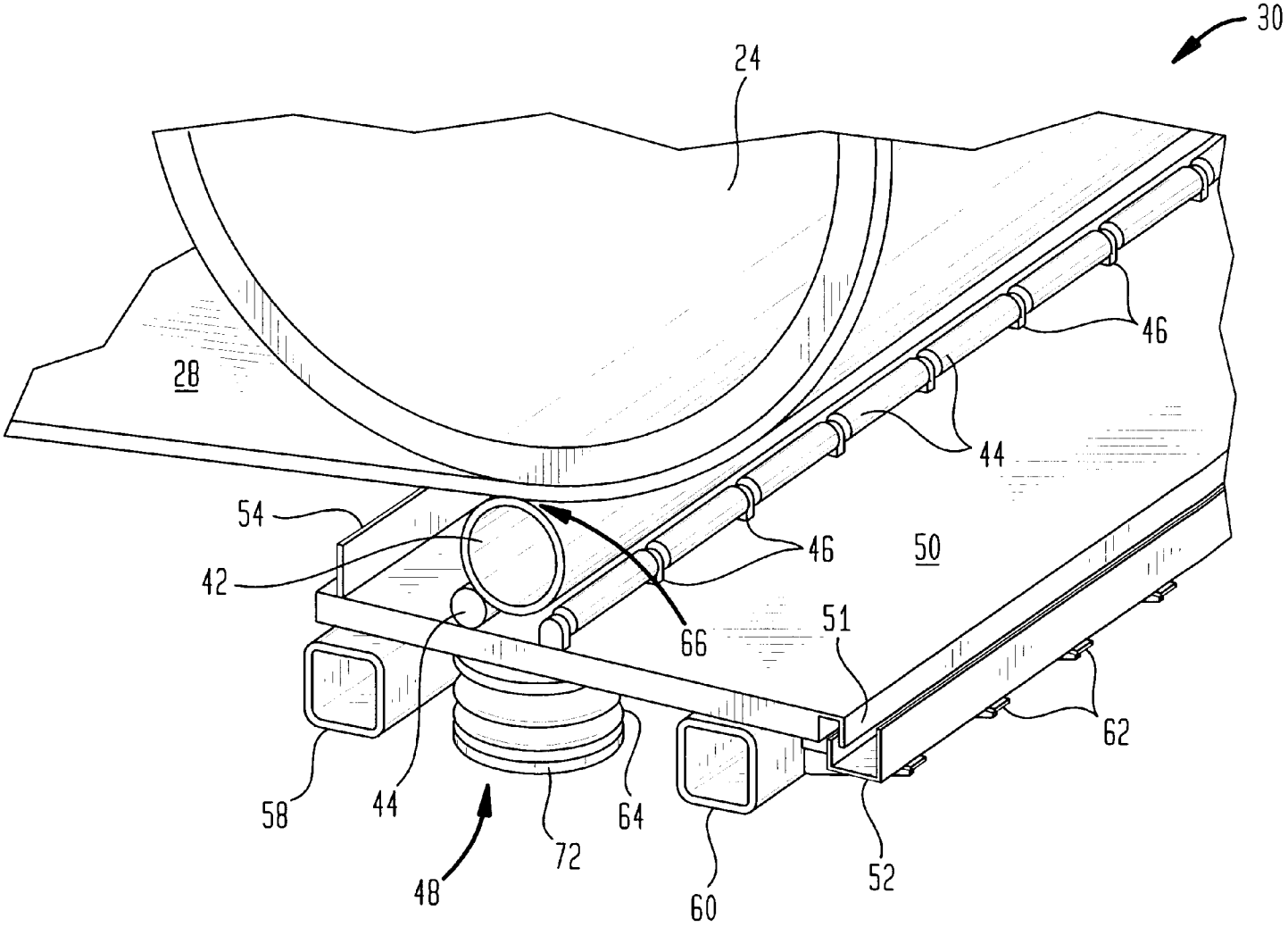
FIG. 5 is an enlarged schematic partial drawing of the press roll system shown in FIG. 3, featuring the press roll, backup rollers, support substrate, a channel, and force actuating devices.

As seen in FIGS. 4 and 5, the backup rollers and mounts are secured and mounted to the top surface of the support substrate 50. Also shown in FIG. 5 is the channel 52, which is secured under a lip 51 of the support substrate 50.

Figure 6:
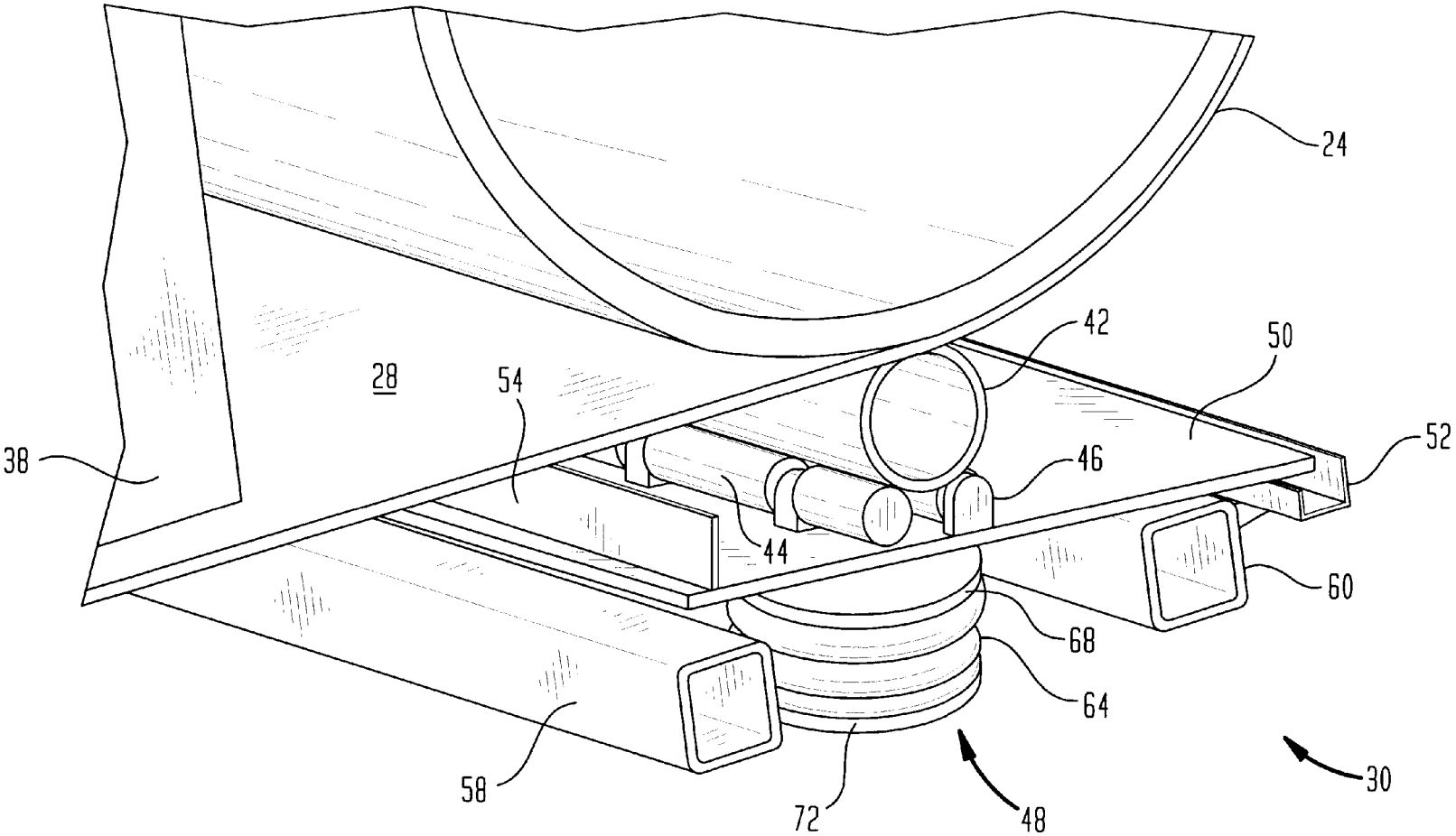
FIG. 6 is a perspective view of the press roll system as shown in FIG. 5, illustrated from a different perspective.

The force actuating devices 48 are shown in detail in FIGS. 5 and 6. Specifically, this particular embodiment utilizes a plurality of force actuating devices or actuators 48 having multiple air bladders 64, which can be inflated and deflated depending on how much total pressing force is required at any given time. Also shown in FIGS. 5 and 6 are pads 68 and 72, which are secured to the top and bottom of the force actuators 48, respectively. The pads 72 come in contact with the foundation 21 when there is a requirement for a pressing force. Specifically, in the resting mode, the force actuators 48 are retracted above the foundation and are contained within the press roll system 30 and, in fact, may be situated within the service cart 74 (see FIG. 7). FIG. 6 also shows the other row of backup rollers 44 and mounts 46. The backup roller system also may consist of one backup roller with multiple mounting points as well.

Figure 7:
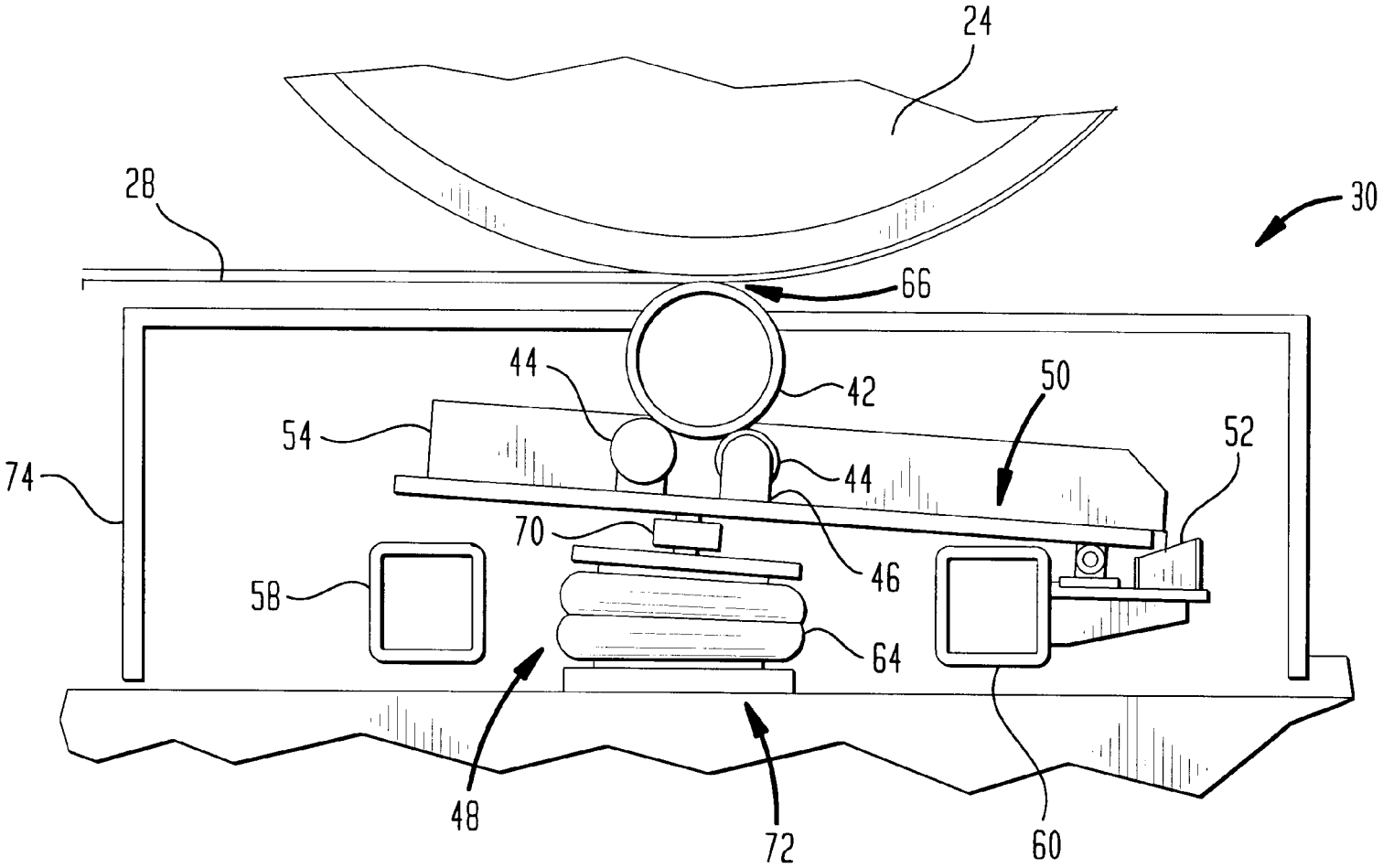
FIG. 7 is a schematic end elevational view of the press roll system.

As best shown in FIG. 7, in certain embodiments, it is desirable to have the support substrate 50 tilt or pivot to one side, with reference to the machine direction, such that any fluid that may be pressed out of the web 28 is caught by the support substrate 50 and channeled toward the channel 52. Thereupon the working fluid is contained in the channel 52 and disposed of in a drain (not shown). Also shown in FIG. 7 is a load transducer 70. At least one load transducer may be placed on at least one force actuator 48 to provide both feed back and control of the force actuators 48 during operation. That is, the load transducer 70 will sense the current pressure being applied to the felt 28 by way of the force being received from the support substrate 50, the backup rollers 44 and the press roll 42.

The angle or tilt of the support substrate 50 in this particular arrangement, is not critical as long as it facilitates the removal of the working fluid from the area. In fact, the support substrate may be V-shaped such that the working fluid is channeled toward the center of the substrate. In this way, all of the equipment, including the force actuators 48, the load transducers 70, the support beams 58 and 60, and any other ancillary equipment that may be found underneath the support substrate 50, are protected from the working fluid.

Figure 8:
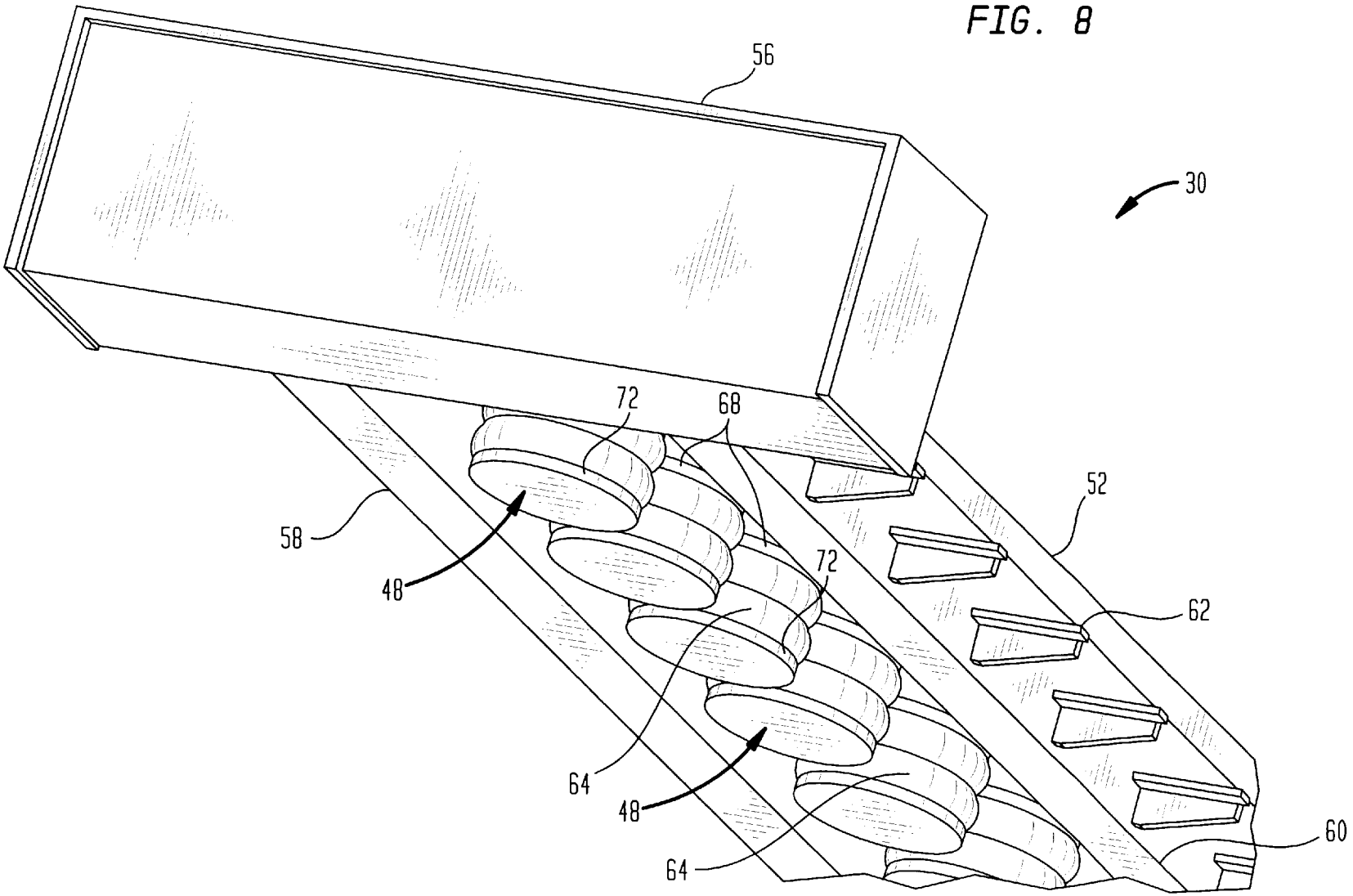
FIG. 8 is a perspective view of the underside of the press roll system, featuring the force actuating devices.

In FIG. 8, the plurality of force actuators 48 are best seen. Here, the pads 68 and 72, the balloons or bellows 64, the channel 52 along with its support 62 are all depicted. The force actuators 48 are shown retracted toward the support substrate.

Figure 9:
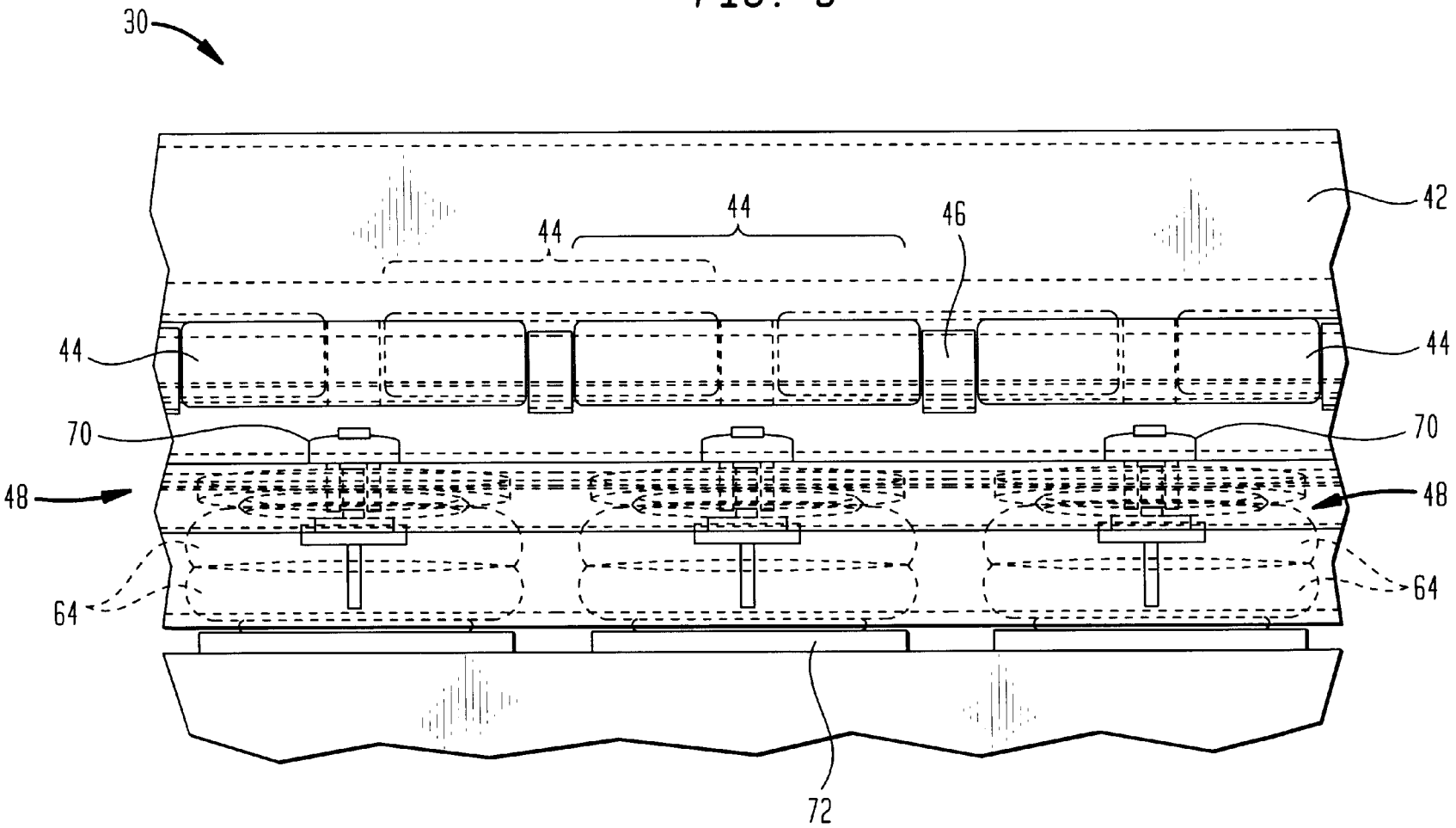
FIG. 9 is a schematic side, elevational view of the force actuating devices, backup rollers, and press role of the press role system.

FIG. 9 discloses the force actuators 48 and the backup rollers 44, as well as, the backup roller mounts 46. As seen in FIG. 9, the two rows of backup rollers 44 are staggered as such to provide a substantially continuous and substantially uniformed pressure and support for the press roll 42 during operation. Also seen in FIG. 9 are load transducers 70, as described above.

Although the press roll system 30 is shown in the "6 O'clock position", i.e., at the bottom of the finishing assembly 20, the present invention is not limited to that position. In fact, the present invention contemplates the use of a press roll system, or a similar setup, in any position around the head roll, for example, in a "9 O'clock" position, a "1O'clock" position, or a "12 O'clock position", i.e., on top of the head roll 24, or any position in between. That is, the press roll system 30 equally may be applied to a finishing assembly, whereby the press roll 42 is above the head roll 24. In this arrangement, the press roll system 30 would have similar force actuation means pressing against the support substrate, which in turn would be pressing against the backup rollers 44 and thus providing a pressing force to the press roll 30. The support substrate may be positioned anywhere between "3-O'clock" and "9-O'clock", but generally not at the "12-O'clock" position. Therefore, if the press roll system 30 is in the "12-O'clock" position, the support substrate would be extending around the head roll or press roll to catch the working fluid dropping off the web or being pressed out.

In operation, the finishing assembly 20 is prepared to receive an endless web or felt thereon. This is achieved by supporting the head roll 24 on the cantilever beam 36. At this point, the air box set 26 is also supported by cantilever beams 36 and 38 and does not interfere with the web.

Once the web 28 is loaded on to the finishing assembly 20, the head roll carriage 35 is then moved into place toward the head roll 24 until it engages with the head roll. The movable or stretch roll 22 is moved by the movable roll carriage 34 along tracks 32 away from the head roll 24 to a predetermined distance or force, depending on the type of process being performed and the size of the endless web 28. This movement of the movable or stretch roll 22 effects a stretching of the endless web 28 to a certain predetermined extent, which also adds to the treatment of the endless web.

Then, the roll drive mechanism is activated and the head roll 24 begins to turn the web for purposes of setting it. The web then begins to travel in the machine direction. This setting may be by mechanical means or by heat means or a combination of both. At this point, the air box set 26 may be activated to begin drying or setting the web 28. In addition, a chemical or other sort of treating fluid may be applied to the web 28. In the alternative, the web 28 may have already had a chemical or treatment fluid applied to it and when it is pressed through the nip area 66, the liquid is pressed out of the web 28.

As the head roll continues to rotate, the force actuators 48 are activated. In this regard, the force actuators extend down to the foundation 21 until they have contacted the foundation. By continuing the inflation of the balloons or bellows 64, a predetermined force is applied to the support substrate 50. At this point, the pads 72 of the force actuators 48 are in contact with the foundation 21. Continuing, the load transducers 70 are now sensing the force being applied and are providing feedback either to an operator or to a computer. Given the feedback results, the force is either further applied or reduced or held constant.

The force actuating devices also may be applied against the service cart assembly instead of the foundation. In this way, the force actuating devices would be independent of the foundation. One advantage of this arrangement is that the press roll system 30 could be retracted into the floor or foundation 21 during non-use and then moved out of the foundation during operation. During this process the force actuating devices would be pressing against the service cart assembly and not the foundation, which may not be available during this transition period.

Once the predetermined force is achieved, the pressure level is set and the head roll continues to rotate, which forces the press roll to rotate within the confines of the backup rollers 44, which are also rotating freely. That is, the backup rollers and the press roll, in this particular embodiment, are not controlled or moved by any outside means other than the movement of the head roll. The present invention also contemplates active press rolls and/or backup rollers, which are controlled and/or moved by an active system, such as a motor.

Thus, the upward force caused by the force actuators 48 begins to treat or set the web 28. At this point, if the web contains any working fluids, they will begin to be pressed out and dropped to the support substrate 50. As seen in FIG. 7, with the support substrate 50 tilted toward the channel 52, the working fluid is urged toward the channel 52 and removed from the press roll system 30, minimizing contamination of the equipment that is arranged underneath.

Therefore, in this particular mode of operation, the endless web 28 is nipped at the nipping area 66 with a given predetermined nipping pressure. This nipping pressure and nip area 66 are maintained in a substantially uniformed manner as a result of the distribution of force being applied. This distribution of force results, in part, from the support substrate 50, which distributes the forces of the force actuators 48 and prevents discreet forces along the cross machine direction of the press roll 42. These forces, in turn, impart a setting effect on the web and produce a substantially uniform caliper.

Although the present invention has been described in considerable detail with reference to certain preferred embodiments thereof, other examples are possible.

For example, as mentioned above, the entire press roll system may be secured and arranged on top of the head roll 24 in such a way that there would be a downward force being placed upon the support substrate 50, which in turn would apply a pressing force to the backup rollers 44 and then to the press roll 42. In addition, other means of providing a force are contemplated by the present invention. For instance, instead of having the discreet force actuating devices 48, which may include expandable balloons or bellows 64 and pads 68 and 72, the force may be created by a single hydraulic lift having a beam extending from one end of the support plate to the other in a cross machine direction. In addition, the force actuating means may comprise a mechanical assembly of springs, having the appropriate spring constant and potential energy to provide the sufficient amount of pressing force needed for any given application.

In addition, the channel 52 could readily be placed on the other lengthwise side of the support substrate 50, whereby the support substrate 50 would be tilted or pivoted toward that side where the channel was attached. Furthermore, the present invention contemplates use of a substantially continuous bladder, which would impart a consistent force upon the press roll. Also, the entire pressing system could be mounted on the service cart and moved out of the finishing assembly to facilitate mounting and removal of the web. In addition, the press roll system may be used to press against a non-activated roll or could even press against a flat surface, either movable or fixed with respect to the foundation. Next, the force being applied also may originate from the inside and press toward the outside. Additionally, the channel could be integral to the support substrate and a blade or squeegee could be used to remove the fluid from the press roll. Finally, the press roll may be liquid permeable. With regard to the backup roller, this may be a single roller with intermediate supports. Other arrangements would allow for the use of different combinations and patterns of backup rollers. Finally, the channel could be placed along the machine direction and the substrate pivoted that way accordingly. Finally, the present invention minimizes edge effects to the fabric, especially when the fabric web is narrow.

Thus, the present invention provides many advantages over the prior art. By way of example only, one of the many advantages of the present invention is that the support substrate 50 provides for a substantially even distribution of force along the entire press roll 42, which provides for a substantially uniform caliper. In addition, the present invention uses a channel 52 to catch and direct the working fluid that comes off the fabric. Also, the backup rollers can be placed anywhere along the length of the press roll 42 by having the availability of being mounted anywhere on the top surface of the support substrate 50. That is, the support substrate is the mounting surface for the backup rollers, and being a substrate or plate, allows for mounting anywhere, irrespective of where the force loading actuator may be located. Another advantage of using the support substrate or plate is that it allows for a more uniform load. Therefore, there is no requirement to have a one to one correspondence between the backup rollers and the force actuating devices. This, in turn, results in a high quality endless loop with substantially uniform caliper. The arrangement also allows for the use of a relatively smaller diameter press roll. It should be understood that the present invention can handle large diameter press rolls as well.

While the foregoing description illustrates preferred embodiments of the press roll system in accordance with the present invention, it should be appreciated that the invention also covers various permutations of the foregoing described features, and that certain modifications may be made in the foregoing without departing from the spirit and scope of the present invention, which is defined by the claims set forth immediately hereafter.

What is claimed is:

1. A press roll system for use in a web finishing assembly, which includes at least one inside treatment roll extending in a direction generally transverse to the machine direction of the finishing assembly, said press roll system comprising:

a. a press roll having a first end and a second end remote from said first end, said press roll extending in a direction generally transverse to the machine direction of the finishing assembly and adjacent the at least one inside treatment roll, said press roll being moveable toward the at least one inside treatment roll to provide a nip area for receiving a traveling web and for applying a nip pressure force to the web;

b. at least one backup roller for supporting said press roll, said at least one backup roller extending between said first end of said press roll and said second end of said press roll;

c. a support substrate extending between said first end of said press roll and said second end of said press roll and supporting said at least one backup roller thereon; and d. a force actuating assembly for providing a pressing load to said press roll to move said press roll toward the at least one inside treatment roll, said force actuating assembly providing said pressing load to said support substrate to, in turn, impart said pressing load to said at least one backup roller supported thereon, whereby the load applied to said press roll is substantially uniformly distributed along the length of said press roll.

2. A press roll system as claimed in claim 1, wherein said support substrate includes a first major surface facing toward said press roll, and a second major surface facing away from said press roll.

3. A press roll system as claimed in claim 2, wherein said at least one backup roller is mounted to said first major surface of said support substrate.

4. A press roll system as claimed in claim 3, wherein said at least one backup roller is arranged on said first surface of said support substrate to provide for continuous support of said press roll substantially along the length of said press roll.

5. A press roll system as claimed in claim 4, further comprising a plurality of backup rollers; said backup rollers being arranged on said first surface of said support substrate such that the ends of certain of said plurality of backup rollers are coincident with the ends of adjacent ones of said plurality of backup rollers, thereby providing a continuous support to said press roll.

6. A press roll system as claimed in claim 5, wherein said force actuating assembly comprises a plurality of force actuating devices mounted and arranged on said second major surface of said support substrate, said plurality of force actuating devices being disassociated from said plurality of backup rollers.

7. A press roll system as claimed in claim 6, wherein said plurality of force actuating devices are retractable toward said second major surface of said support substrate when said press roll system is in a rest state and expandable toward the foundation to provide support and force to said press roll during operation of said press roll system.

8. A press roll system as claimed in claim 7, wherein said plurality of force actuating devices comprise pneumatically driven air bags.

9. A press roll system as claimed in claim 1, further comprising a service cart assembly for supporting and containing said press roll system when said press roll system is moved.

10. A press roll system as claimed in claim 6, further comprising at least one load transducer mounted between said second major surface of said support substrate and said plurality of force actuating devices to provide feedback and control of the amount of force that is to be applied to said nip area of said press roll system.

11. The press roll system of claim 1, wherein said at least one backup roller and said support substrate extend from substantially adjacent said first end of said press roll to substantially adjacent said second end of said press roll.

12. The press roll system of claim 1, wherein said at least one inside treatment roll comprises a head roll.

13. The press roll system of claim 2, wherein said support substrate further comprises a channel positioned at one end of said support substrate, said channel extending substantially along the length of said support substrate end.

14. The press roll system of claim 10, wherein said support substrate is tilted toward said end where said channel is positioned to facilitate the flow of working fluid toward said channel.

15. A press roll system as claimed in claim 1, wherein said press roll system is moveable away from said head roll to provide sufficient space for the web to be loaded onto the finishing assembly.

16. A press roll system as claimed in claimed 15, wherein said press roll system is moveable into the floor on which the finishing assembly is supported.

17. A press roll system as claimed in claim 6, further comprising a service cart assembly for supporting and containing said press roll system.

18. A press roll system as claimed in claim 17, wherein said plurality of force actuating devices are expandable within said service cart assembly and said force actuating devices are moveable toward said service cart assembly to provide support and force to said press roll during operation of said press system.

19. A press roll system as claimed in claim 9, wherein said service cart assembly is moveable to facilitate loading and unloading of the web.

20. A press roll system as claimed in claim 9, wherein said service cart assembly is moveable to facilitate removal of said press roll.

21. A press roll system as claimed in claim 10, wherein said at least one load transducer includes a plurality of transducers disposed along the cross machine direction of said press roll system.

22. A press roll system as claimed in claim 1, wherein said support substrate is non-continuous along the cross machine direction of said press roll system.

23. A press roll system as claimed in claim 22, wherein said support substrate comprises a plurality of discrete pieces separated by predetermined gaps therebetween.

24. A press roll system for use in a web finishing assembly, which includes a head roll extending in a direction generally transverse to the machine direction of the finishing assembly, said press roll system comprising:

a. a service cart for supporting said press roll system;

b. a press roll rotatably secured in said service cart, said press roll having a first end and a second end remote from said first end, and said press roll extending in a direction generally transverse to the machine direction of the finishing assembly and adjacent the head roll, said press roll being moveable toward the head roll to provide a substantially uniform nip area for receiving a traveling web and for applying a nip pressure force to the web;

c. a plurality of backup rollers for supporting said press roll to reduce movement of said press roll in the machine direction during operation, said plurality of backup rollers extending substantially between said first end of said press roll and said second end of said press roll;

d. a support substrate extending between said first end of said press roll and said second end of said press roll and supporting said plurality of backup rollers thereon, said support substrate having a first major surface and a second major surface, wherein said plurality of backup rollers are mounted to said first major surface of said support substrate; and e. a plurality of force actuating devices for providing a pressing load to said press roll to move said press roll toward the head roll, said plurality of force actuating devices providing said pressing load to said press roll through said support substrate and said plurality of backup rollers, whereby the load applied to said press roll is uniformly distributed along substantially the length of said press roll.

25. A press roll system for use in a web finishing assembly, which includes at least one inside treatment roll extending in a direction generally transverse to the machine direction of the finishing assembly, said press roll system comprising:

a. a press roll having a first end and a second end remote from said first end, said press roll extending in a direction generally transverse to the machine direction of the finishing assembly and adjacent the at least one inside treatment roll, said press roll being moveable toward the at least one inside treatment roll to provide a nip area for receiving a traveling web and for applying a nip pressing force to the web;

b. a plurality of backup rollers for supporting said press roll, said plurality of backup rollers extending between said first end of said press roll and said second end of said press roll;

c. a force actuating assembly for providing a pressing load to said press roll to move said press roll toward the at least one inside treatment roll, the pressing load being applied to said press roll in a uniform distribution along substantially the length of said press roll; and d. a fluid collection substrate extending lengthwise between said first end of said press roll and said second end of said press roll and beneath said plurality of backup rollers and above said force actuating assembly.

26. A press roll system as claimed in claim 25, wherein said fluid collection substrate further comprises a channel positioned at one end of said fluid collection substrate, said channel substantially extending along the length of said end.

27. A press roll system as claimed in claim 25, wherein said fluid collection substrate is tilted toward said end where said channel is positioned to facilitate the flow of fluid toward said channel and away from said force actuating assembly.

* * * * *

UNITED STATES PATENT AND TRADEMARK OFFICE

CERTIFICATE OF CORRECTION

PATENT NO. : 6,061,885

DATED : May 16, 2000

INVENTOR(S) : White et al.

It is certified that error appears in the above-identified patent and that said Letters Patent is hereby corrected as shown below:

Col. 8, line 42, "1O'clock" should read --3 O'clock--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*